US005966757A

United States Patent [19]

Sullivan

[11] Patent Number: 5,966,757

[45] Date of Patent: Oct. 19, 1999

[54] STAY PUT TOWEL/BLANKET SYSTEM

[76] Inventor: Donald W. Sullivan, 18950 SW. 53rd St., Fort Lauderdale, Fla. 33332

[21] Appl. No.: 09/105,434

[22] Filed: Jun. 26, 1998

[51] Int. Cl.[6] ..... A47G 9/06

[52] U.S. Cl. ..... 5/417; 5/484; 5/502; 5/419

[58] Field of Search ..... 5/417, 419, 420, 5/484, 502

[56] References Cited

U.S. PATENT DOCUMENTS

| | | | |
|---|---|---|---|
| 2,870,464 | 1/1959 | Lalick | 5/420 |
| 3,801,420 | 4/1974 | Anderson | 5/502 X |
| 4,634,618 | 1/1987 | Greer et al. | 5/417 |
| 4,999,866 | 3/1991 | Lindsey | 5/417 |
| 5,261,131 | 11/1993 | Kilby | 5/417 X |
| 5,353,453 | 10/1994 | Naumann | 5/417 |
| 5,386,603 | 2/1995 | Drust | 5/417 |

*Primary Examiner*—Michael F. Trettel

[57] ABSTRACT

A stay put towel/blanket comprising one or more essentially rectangular towel/blankets fabricated of a fabric with a length, a rectangular periphery, the towel/blanket having an upper surface and a lower surface, the lower surface having strips of a pile-type fastener secured thereto from a location at the periphery to a region inwardly therefrom and an essentially rectangular backing sheet fabricated of a plastic material with a length greater than the length of one or more towel/blanket and a width greater than the width of one or more towel/blanket forming a rectangular periphery, the periphery being formed with a hem created by the folding of the backing sheet at its periphery at a location extending outwardly of the periphery of one or more towel/blankets, the hem having a weight means therein for weighting purposes, the sheet also having an upper surface and a lower surface, the upper surface including strips of a pile-type fastener secured there around at a location inwardly of the periphery and hem and across in alignment with the pile-type fastener of one or more towel/blankets for the removable coupling between one or more towel/blankets and the backing sheet, the upper surface further including various pockets and inflatable compartments, the lower surface having including one or more handles for being grasped by a user when the system is rolled up for transportation and storage.

11 Claims, 3 Drawing Sheets

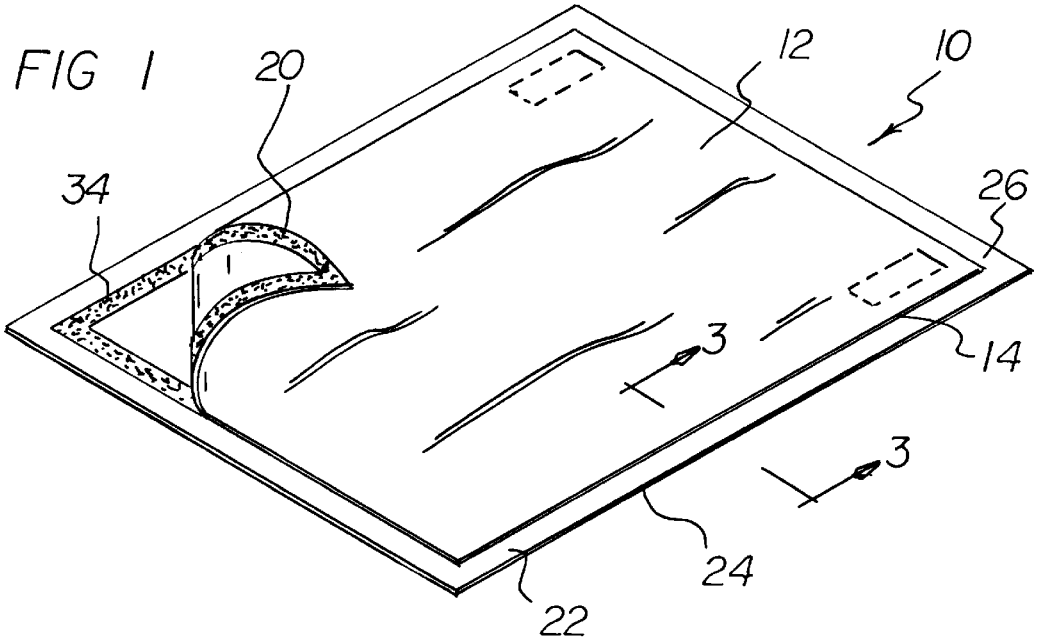
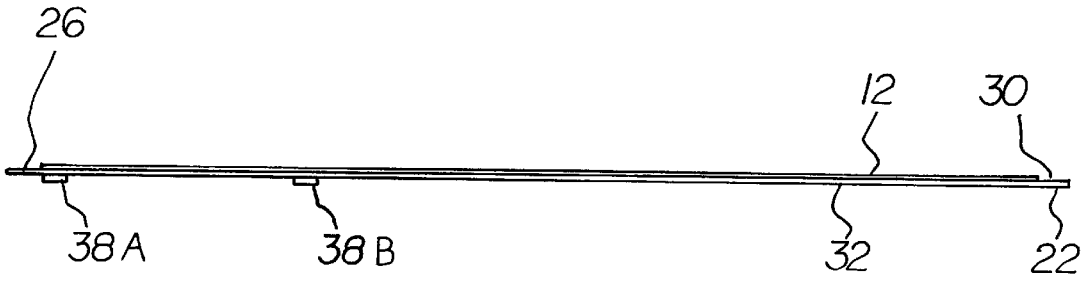
FIG 2

FIG 3
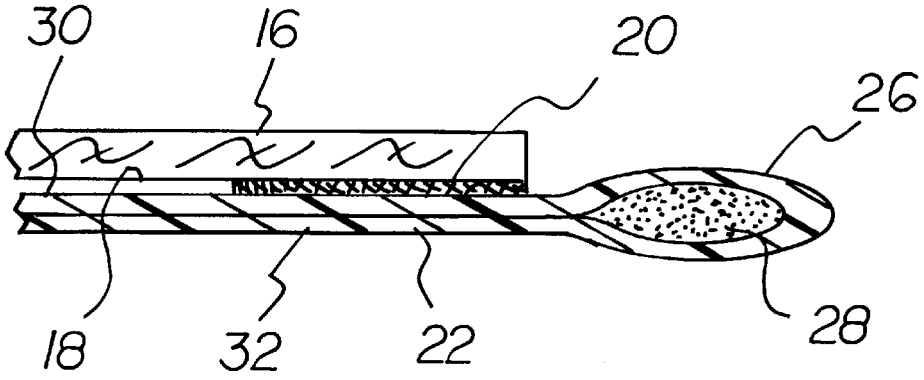
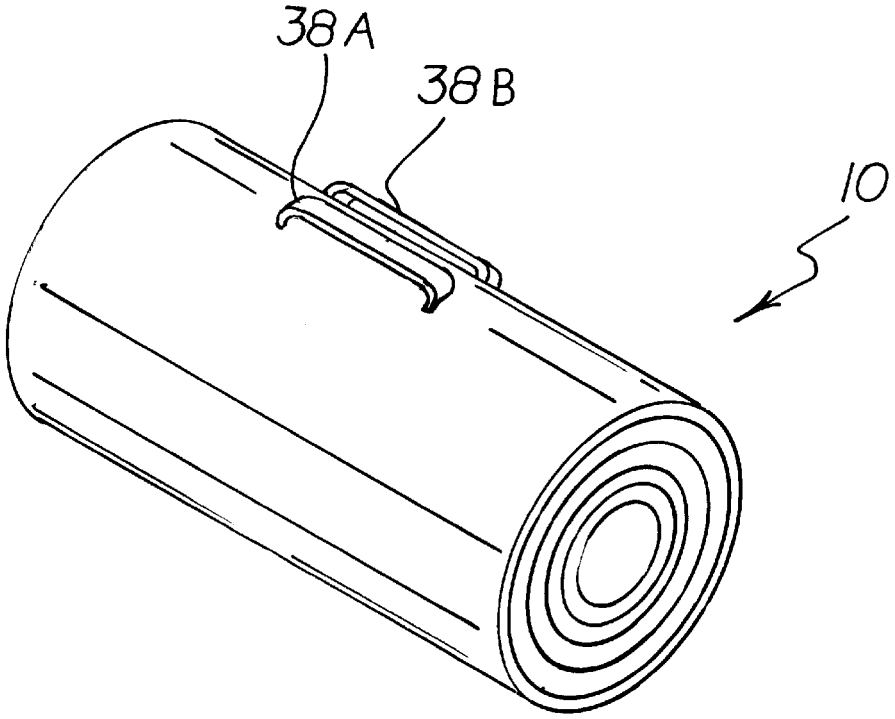
FIG 4

STAY PUT TOWEL/BLANKET SYSTEM

BACKGROUND OF THE INVENTION

1. Field of the Invention

The present invention relates to a stay put towel/blanket system and more particularly pertains to precluding blankets and towels from blowing away.

2. Description of the Prior Art

The use of blankets and towels of various designs and configurations is known in the prior art. More specifically, blankets and towels of various designs and configurations heretofore devised and utilized for the purpose of retaining objects in place while under the force of the wind are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,018,229 which discloses a Pocketed Beach Towel U.S. Pat. No. 3,226,737 discloses a Beach and Picnic Blanket.

U.S. Pat. No. 4,634,618 discloses a Weighted Towel.

U.S. Pat. No. 5,206,964 discloses a Beach Blanket Stabilizer.

U.S. Pat. No. 5,072,467 discloses a Beach Towel With Pockets.

Lastly, U.S. Pat. No. 2,647,718 discloses a Picnic Cloth Holder.

In this respect, the stay put towel/blanket system according to the present invention substantially departs from the conventional concepts and designs of the prior art, and in so doing provides an apparatus primarily developed for the purpose of precluding blankets and towels from blowing away.

Therefore, it can be appreciated that there exists a continuing need for a new and improved stay put towel/blanket system which can be used for precluding blankets and towels from blowing away. In this regard, the present invention substantially fulfills this need.

SUMMARY OF THE INVENTION

In view of the foregoing disadvantages inherent in the known types of blankets and towels of various designs and configurations now present in the prior art, the present invention provides an improved stay put towel/blanket system. As such, the general purpose of the present invention, which will be described subsequently in greater detail, is to provide a new and improved stay put towel/blanket which has all the advantages of the prior art and none of the disadvantages.

To attain this, the present invention essentially comprises a new and improved stay put towel/blanket system comprising, in combination one or more essentially rectangular towel/blankets fabricated of a woven fabric with a length and a width forming a rectangular periphery. The towel/blanket has an upper surface and a lower surface, the lower surface having strips of a pile-type fastener secured thereto from a location at the periphery to a region inwardly therefrom. Also provided is an essentially rectangular backing sheet fabricated of a vinyl material with a length greater than the length of one or more towel/blanket and a width greater than the width of one or more towel/blanket forming a rectangular periphery. The periphery is formed with a hem created by the folding of the backing sheet at its periphery at a location extending outwardly of the periphery of one or more towel/blanket. The hem has a weight means therein for weighting purposes. The sheet also has an upper surface and a lower surface, the upper surface including strips of a pile-type fastener secured there around at a location inwardly of the periphery and hem and across in alignment with the pile-type fastener of one or more towel/blanket for the removable coupling between one or more towel/blanket and the backing sheet. The upper surface further including various pockets and inflatable compartments attached to or integrated therein. Lastly provided is a handle secured to the lower surface of the backing sheet for being grasped by a user when the system is rolled up for transportation and storage.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved stay put towel/blanket system which has all the advantages of the prior art blankets and towels of various designs and configurations and none of the disadvantages.

It is another object of the present invention to provide a new and improved stay put towel/blanket system which may be easily and efficiently manufactured and marketed.

It is a further object of the present invention to provide a new and improved stay put towel/blanket system which is of a durable and reliable construction.

An even further object of the present invention is to provide a new and improved stay put towel/blanket system which is susceptible of a low cost of manufacture with regard to both materials and labor, and which accordingly is then susceptible of low prices of sale to the consuming public, thereby making such stay put towel/blanket economically available to the buying public.

Still yet another object of the present invention is to provide a new and improved stay put towel/blanket system which provides in the apparatuses and methods of the prior art some of the advantages thereof, while simultaneously overcoming some of the disadvantages normally associated therewith.

Still another object of the present invention is to preclude blankets and towels from blowing away.

Lastly, it is an object of the present invention to provide a new and improved stay put towel/blanket comprising one or more essentially rectangular towel/blankets fabricated of a fabric with a length and a width forming a rectangular periphery. The towel/blanket has an upper surface and a lower surface, the lower surface having strips of a pile-type fastener secured thereto from a location at the periphery to a region inwardly therefrom. Also provided is an essentially rectangular backing sheet fabricated of a plastic material with a length greater than the length of one or more towel/blanket and a width greater than the width of the towel/blanket forming a rectangular periphery. The periphery is formed with a hem created by the folding of the backing sheet at its periphery at a location extending outwardly of the periphery of the towel/blanket, the hem having a weight means therein for weighting purposes, the sheet also having an upper surface and a lower surface, the upper surface including strips of a pile-type fastener secured there around at a location inwardly of the periphery and hem and across in alignment with the pile-type fastener of one or more towel/blanket for the removable coupling between one or more towel/blanket and the backing sheet.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of the preferred embodiment of the stay put towel/blanket system constructed in accordance with the principles of the present invention.

FIG. 2 is an end elevational view of the device shown in FIG. 1.

FIG. 3 is a cross-sectional view taken along line 3—3 of FIG. 1.

FIG. 4 is a perspective view of the device of the prior figures when rolled up for storage or transportation.

Similar reference characters refer to similar parts throughout the several views of the drawings.

DESCRIPTION OF THE PREFERRED EMBODIMENT

Figure 5:
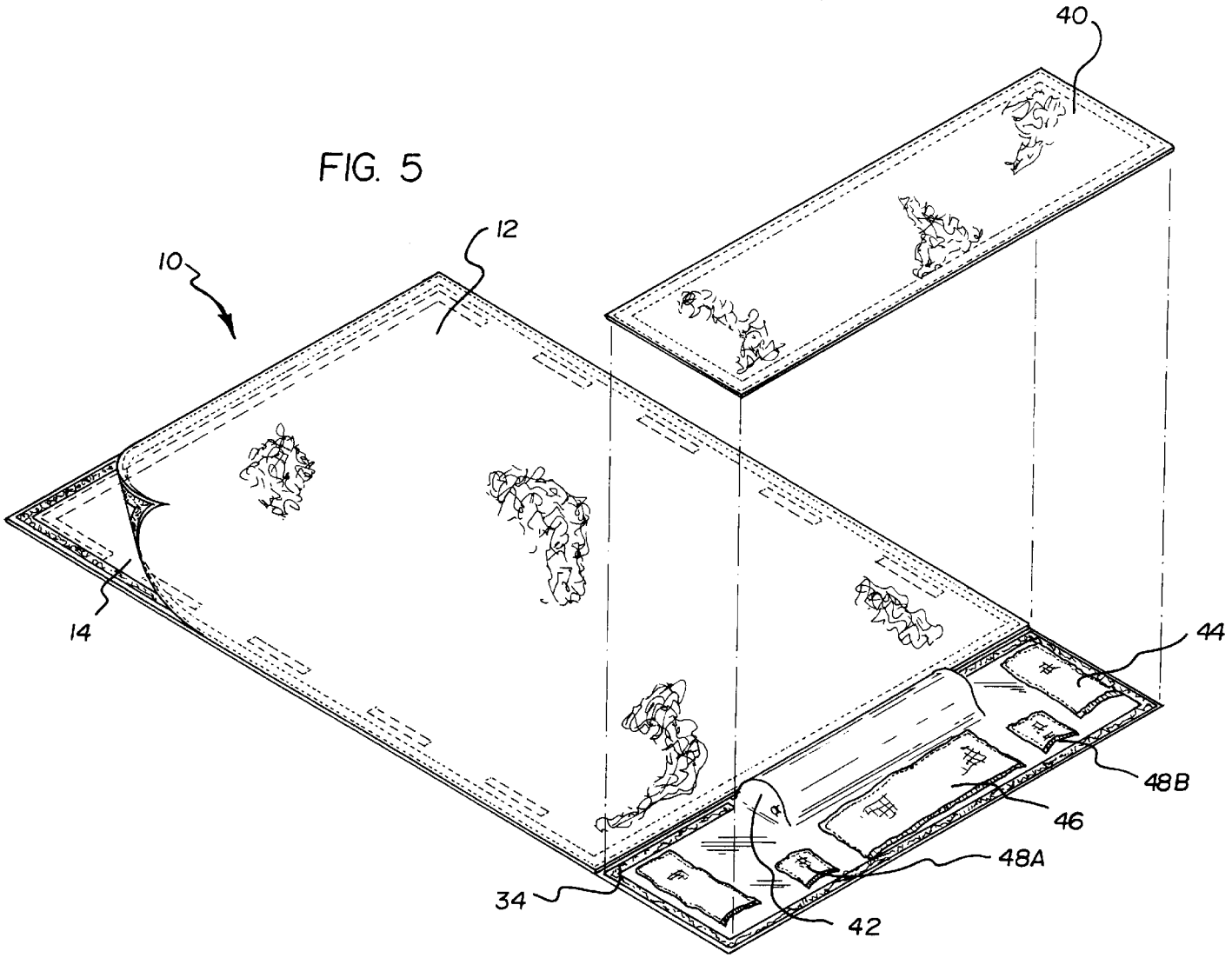
FIG. 5 is a perspective view of another embodiment of the device of the prior figures.

With reference now to the drawings, and in particular to FIG. 1 thereof, a new and improved stay put towel/blanket system embodying the principles and concepts of the present invention and generally designated by the reference numeral 10 will be described.

The present invention, the new and improved stay put towel/blanket system, is comprised of a plurality of components. Such components are individually configured and correlated with respect to each other so as to attain the desired objective.

More specifically, it will be noted that the new and improved stay put towel/blanket system 10 for precluding blankets and towels from blowing away comprises one or more essentially rectangular towel/blanket 12 and 40. It is fabricated of a woven fabric with a length and a width forming a rectangular periphery 14. The towel/blanket has an upper surface 16 and a lower surface 18. The lower surface has strips of a pile-type fastener 20 secured thereto from a location at the periphery to a region inwardly therefrom.

Also provided is an essentially rectangular backing sheet 22 fabricated of a vinyl material with a length greater than the length of the towel/blanket. The backing sheet has a width greater than the width of the towel/blanket forming a rectangular periphery 24. The periphery is formed with a hem 26 created by the folding of the backing sheet at its periphery at a location extending outwardly of the periphery of the towel/blanket. The hem has a weight means 28 therein for weighting purposes. The sheet also has an upper surface 30 and a lower surface 32, the upper surface including strips of a pile-type fastener 34 secured there around at a location inwardly of the periphery and hem and across in alignment with the pile-type fastener of the towel/blanket for the removable coupling between the towel/blanket and the backing sheet. Also, the upper surface including one or more pockets 44, 46, 48A and 48B attached to or integrated therein. Further, the upper surface including one or more inflatable compartments 42 attached to or integrated therein.

Also provided is a handle 38A and a handle 38B secured to the lower surface of the backing sheet for being grasped by a user when the system is rolled up for transportation and storage.

The present system as explained herein above is a towel/blanket that remains securely in place so as not to be blown about easily by the wind. Further, the towel/blanket secures from view one or more pockets. Also, the towel/provides inflatable compartments. The present invention provides enhanced comfort for individuals who frequent the beach or pool, attend picnics, sunbathe, etc.

The system consists of a rectangular terry cloth towel and/or blanket which is secured to a slightly larger section of stamped vinyl. The vinyl sheeting rests upon the underside of the towel and covers the perimeter of the top of the towel. The towel is secured in place through the use of pile-type fasteners. Corresponding sections of pile-type fasteners rest upon the sheet of vinyl. The section of vinyl rests atop the towel and, preferably, measures ½ inch in width and is filled with a weighted means to securely hold the towel in place. The towel is easily removable for laundering. The section of vinyl incorporates a handle through which this product is easily carried when it is not in use. The towel is simply rolled up and the handle is employed to support it. The towel is available in various colors with a wide array of decorative designs. It is possible to produce this product in two sizes. For example, one version is for use by one person and measures 8 feet long by 2 feet wide. The family version measures 8 feet long by 6 feet wide.

The appealing features of this system are its convenience, ease of use, and reasonable price. This system provides the beach goer with a means to keep his towel from blowing about. Thus, the towel does not need to be continually repositioned or the corners turned over after being blown by the wind. The sunbather is free to relax and not worry about these hassles. Thus, the use of this product increases the sunbather's comfort and enjoyment of the leisure time activity. This product is practical, compact, durable, easy to transport, and brightly colored.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved stay put towel/blanket system for precluding blankets and towels from blowing away comprising, in combination:

an essentially rectangular towel/blanket fabricated of a woven fabric with a length and a width forming a rectangular periphery, the towel/blanket having an upper surface and a lower surface, the lower surface having strips of a pile-type fastener secured thereto from a location at the periphery to a region inwardly therefrom;

an essentially rectangular backing sheet fabricated of a vinyl material with a length greater than the length of the towel/blanket and a width greater than the width of the towel/blanket forming a rectangular periphery, the periphery being formed with a hem created by the folding of the backing sheet at its periphery at a location extending outwardly of the periphery of the towel/blanket, the hem having a weight therein for weighting purposes, the sheet also having an upper surface and a lower surface, the upper surface including strips of a pile-type fastener secured there around at a location inwardly of the periphery and hem and in alignment with the pile-type fastener of the towel/blanket for the removable coupling between the towel/blanket and the backing sheet; and a handle secured to the lower surface of the backing sheet for being grasped by a user when the system is rolled up for transportation and storage.

2. The system as claimed in claim 1 and further including a pocket attached to the upper surface of the backing sheet.

3. The system as claimed in claim 1 and further including a pocket integrated into the upper surface of the backing sheet.

4. The system as claimed in claim 1 and further including an inflatable compartment attached to the upper surface of the backing sheet.

5. The system as claimed in claim 1 and further including an inflatable compartment integrated into the upper surface of the backing sheet.

6. A stay put towel/blanket system comprising:

an essentially rectangular towel/blanket fabricated of a fabric with a length and a width forming a rectangular periphery, the towel/blanket having an upper surface and a lower surface, the lower surface having strips of a pile-type fastener secured thereto from a location at the periphery to a region inwardly therefrom; and an essentially rectangular backing sheet fabricated of a plastic material with a length greater than the length of the towel/blanket and a width greater than the width of the towel/blanket forming a rectangular periphery, the periphery being formed with a hem created by the folding of the backing sheet at its periphery at a location extending outwardly of the periphery of the towel/blanket, the hem having a weight therein for weighting purposes, the sheet also having an upper surface and a lower surface, the upper surface including strips of a pile-type fastener secured there around at a location inwardly of the periphery and hem and in alignment with the pile-type fastener of the towel/blanket for the removable coupling between the towel/blanket and the backing sheet.

7. The system as claimed in claim 6 and further including a handle secured to the lower surface of the backing sheet for being grasped by a user when the system is rolled up for transportation and storage.

8. The system as claimed in claim 6 and further including a pocket attached to the upper surface of the backing sheet.

9. The system as claimed in claim 6 and further including a pocket integrated into the upper surface of the backing sheet.

10. The system as claimed in claim 6 and further including an inflatable compartment attached to the upper surface of the backing sheet.

11. The system as claimed in claim 6 and further including an inflatable compartment integrated into the upper surface of the backing sheet.

* * * * *